US007182244B2

(12) United States Patent
Brown

(10) Patent No.: US 7,182,244 B2
(45) Date of Patent: Feb. 27, 2007

(54) MAILBOX

(75) Inventor: Lee S. Brown, Montague, MI (US)

(73) Assignee: Whitehall Products, LLC, Montague, MI (US)

( * ) Notice: Subject to any disclaimer, the term of this patent is extended or adjusted under 35 U.S.C. 154(b) by 226 days.

(21) Appl. No.: 10/923,457

(22) Filed: Aug. 20, 2004

(65) Prior Publication Data

US 2005/0184142 A1 Aug. 25, 2005

Related U.S. Application Data

(60) Provisional application No. 60/547,668, filed on Feb. 25, 2004.

(51) Int. Cl.
*A47G 29/14* (2006.01)

(52) U.S. Cl. ..... 232/38; 232/17; 232/45; 40/606.06; 220/651; 220/652

(58) Field of Classification Search ..... 232/17, 232/45, 38, 44; 40/606.06; 16/229, 386; 220/616, 622, 651, 652
See application file for complete search history.

(56) References Cited

U.S. PATENT DOCUMENTS

| | | | | |
|---|---|---|---|---|
| 471,918 | A | 3/1892 | Van Pelt | |
| 597,420 | A | 1/1898 | Kelly | |
| 693,917 | A | 2/1902 | Stansel | |
| 951,090 | A | 3/1910 | Kilian | |
| 1,168,138 | A | 1/1916 | Wyatt | |
| 1,211,186 | A | 1/1917 | Lee | |
| 1,326,333 | A | 12/1919 | Frank | |
| 1,432,843 | A | 10/1922 | Dooley | |
| 1,461,565 | A * | 7/1923 | Velte | 40/1.6 |
| 1,542,217 | A | 6/1925 | Cole | |
| 1,628,200 | A | 5/1927 | Scott | |
| 1,691,638 | A * | 11/1928 | Carney | 40/620 |
| 1,818,182 | A | 8/1931 | Woernle | |
| 1,839,834 | A | 1/1932 | Coleman | |
| 1,906,504 | A * | 5/1933 | Allison, Sr. | 40/583 |
| 1,967,104 | A | 7/1934 | Sorrow, Jr. | |
| 2,254,755 | A * | 9/1941 | Sand | 24/613 |

(Continued)

OTHER PUBLICATIONS

Exhibit A : brochure by Salsbury Industries of a prior art mailbox of interest manufactured and offered for sale at least as early as the filing date of the present application.

(Continued)

*Primary Examiner*—William L. Miller
(74) *Attorney, Agent, or Firm*—Price Heneveld, Cooper, DeWitt & Litton LLP

(57) ABSTRACT

A mailbox includes opposing side pieces, a bottom piece, a rear piece, and a door, all made from die-cast aluminum. The side pieces include abutting top flanges and the mailbox further includes a channel engaging the top flanges to hold the top flanges together. Screws extend through the channel into threaded engagement with the top flanges, and also extend through apertures into apertured bosses to secure all components together. Address signage (sand-cast) is provided for selective attachment to the sides, door or top of the mailbox. The door is pivotally mounted to the mailbox by a pivot pin that telescopingly extends into holes in the side pieces to facilitate assembly.

12 Claims, 12 Drawing Sheets

U.S. PATENT DOCUMENTS

| | | | | |
|---|---|---|---|---|
| D154,470 | S | 7/1949 | Gieseler | |
| 2,509,930 | A * | 5/1950 | Kohl | 40/606.06 |
| 2,573,413 | A | 10/1951 | Duncan | |
| 2,578,693 | A | 12/1951 | Gieseler | |
| 2,607,141 | A | 8/1952 | Petersen | |
| 2,976,633 | A | 3/1961 | Squire | |
| D190,539 | S | 6/1961 | Hirschfeld | |
| 3,825,173 | A | 7/1974 | Sunday | |
| 4,149,333 | A | 4/1979 | Garfinkle | |
| D254,335 | S | 2/1980 | Hodge | |
| 4,223,828 | A * | 9/1980 | Whitley et al. | 232/45 |
| 4,275,829 | A | 6/1981 | Johnson et al. | |
| 4,368,842 | A | 1/1983 | DeLange, III | |
| 4,872,610 | A | 10/1989 | Grabowiecki | |
| D334,272 | S | 3/1993 | Gaines | |
| D335,755 | S | 5/1993 | Davis et al. | |
| D335,903 | S | 5/1993 | Swindle | |
| 5,346,125 | A | 9/1994 | Critzer, Sr. | |
| 5,449,111 | A | 9/1995 | Sauzedde et al. | |
| 5,522,540 | A | 6/1996 | Surman | |
| 5,524,858 | A | 6/1996 | Friend | |
| D376,248 | S | 12/1996 | Erwin et al. | |
| D388,232 | S | 12/1997 | Valentino | |
| D390,328 | S | 2/1998 | Barton, Jr. | |
| D393,532 | S | 4/1998 | Black et al. | |
| D402,783 | S | 12/1998 | Lamolinara | |
| D445,988 | S | 7/2001 | Gaines et al. | |
| D448,911 | S | 10/2001 | Gaines et al. | |
| D450,170 | S | 11/2001 | Gaines et al. | |
| D476,692 | S | 7/2003 | Gaines et al. | |
| D477,033 | S | 7/2003 | Gaines et al. | |
| D477,036 | S | 7/2003 | Gaines et al. | |
| D477,367 | S | 7/2003 | Gaines et al. | |
| D477,369 | S | 7/2003 | Gaines et al. | |
| 6,668,476 | B1 | 12/2003 | Gaines et al. | |
| 6,722,561 | B1 * | 4/2004 | Thomas et al. | 232/39 |
| 2002/0190116 | A1 | 12/2002 | Lackey et al. | |
| 2006/0054677 | A1 * | 3/2006 | Africa | 232/17 |

OTHER PUBLICATIONS

Exhibit B : Catalog by Custom Home Accessories, Sacramento, CA, showing prior art mailboxes of interest manufactured and offered for sale at least as early as the filing date of the present application.

* cited by examiner

MAILBOX

This application claims benefit under 35 USC 119(e) of a provisional application Ser. No. 60/547,668, filed Feb. 25, 2004, entitled MAILBOX, the entire contents of which are incorporated herein by reference.

BACKGROUND

The present invention relates to mailboxes, and more particularly relates to a mailbox construction made of durable and long-lasting components configured for easy assembly, including selective attachment of accessories such as address signage.

Mailboxes are subject to considerable abuse from weather, sun, and other outdoor occurrences as well as physical wear and tear from normal use. Many consumers want a solid durable mailbox that is impressive and that will last a long time and further that will maintain its attractive appearance even when subject to weather and abuse. Mailboxes made from hand cast materials can meet this need, but they tend to be expensive to make, assemble, and ship. It is desirable to construct a mailbox made from cast materials that can be compactly shipped in a knocked-down state, easily assembled on site, and that is durable and robust when assembled.

Consumers also want a distinctive mailbox that can be customized and personalized to meet their particular needs, including a choice regarding how their particular address is displayed. In particular, consumers want flexibility in the type and style of their address signage. For example, some consumers prefer a topper signage that extends vertically from a top of the mailbox, while others prefer signage on a side or front of the mailbox. However, it is prohibitively expensive to manufacture a different mailbox to accommodate each different address location, since this would require additional molds and also added inventory. The dilemma is that the mailbox with signage must have an attractive appearance consistent with the style and image of the overall mailbox regardless of where the address signage is attached. Further, any area left uncovered on the mailbox must have an attractive appearance even though there is no signage covering it. Suffice it to say that it is not easy to build into a mailbox design the ability to securely attach signage at different locations with all combinations looking aesthetically optimal.

Thus, a system having the aforementioned advantages and solving the aforementioned problems is desired.

SUMMARY OF THE PRESENT INVENTION

In one aspect of the present invention, a mailbox includes opposing side pieces, a bottom piece, and a rear piece secured together. A door is operably attached for closing a front opening therein. The side pieces include abutting top flanges and the mailbox further includes a channel engaging the top flanges to hold the top flanges together. Fasteners secure the channel in engagement with the top flanges. In a narrower form, the opposing side pieces, the bottom piece, and the rear piece are made from hand-cast material, such as aluminum.

In another aspect of the present invention, a kit includes a mailbox with cast side pieces having holes therein, and also includes an address panel signage. Threaded studs are provided that have a first portion threadably engaging a rear surface of the address plaque and have a second portion extending therefrom in a pattern matching the holes. Nuts engage the second portion of the threaded studs to secure the address panel signage to the side pieces.

In still another aspect of the present invention, a kit includes a mailbox having a box portion and a door. The kit further includes a plurality of address panel signage, including a first signage shaped to fit against a side of the mailbox, a second signage shaped to fit against the door, and a third signage shaped with down bosses for attachment to a top of the mailbox. Threaded studs are provided having a first portion adapted to threadably engage a selected one of the panel signage and having a second portion extending therefrom in a pattern. Nuts are provided that are shaped to engage the second portion of the threaded studs to secure the address panel signage to the mailbox or door.

In yet another aspect of the present invention, a mailbox includes a mailbox portion having an open end, and a door shaped to close the open end. A hinge is provided with a pivot pin, the pin having a center engaging the door and having ends engaging pockets in sides of box portion near the open end, the pin being telescopingly extendable to facilitate assembly.

In additional to the functional aspects, the present appearance and design are believed to be novel, ornamental, non-obvious, and hence patentable.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
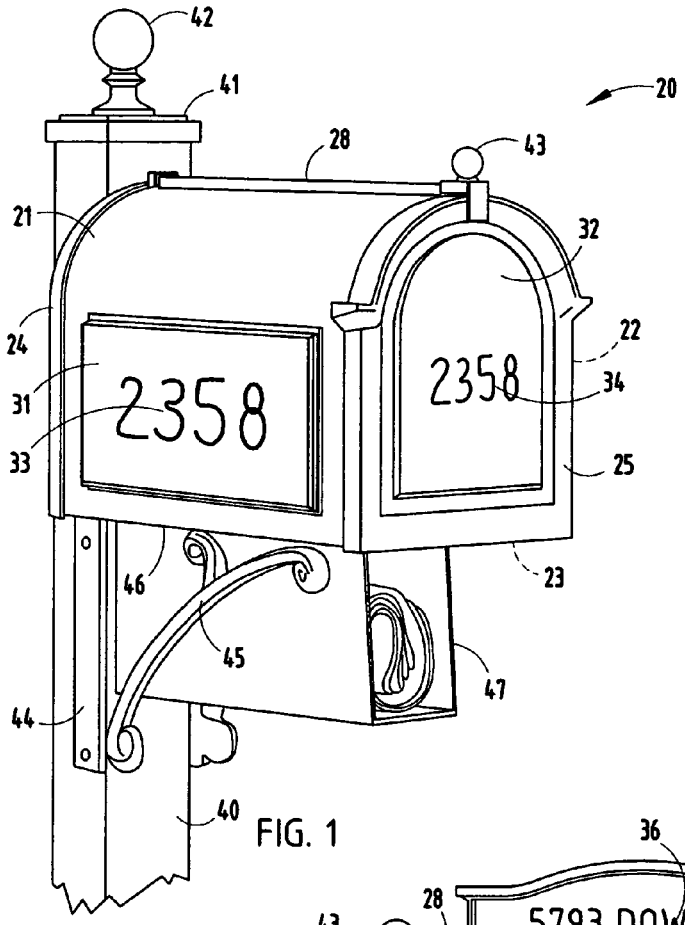
FIG. 1 is a perspective view of a mailbox supported on a side of a post and having an under-box newspaper holder and also having front and side address signage.
Figure 2:
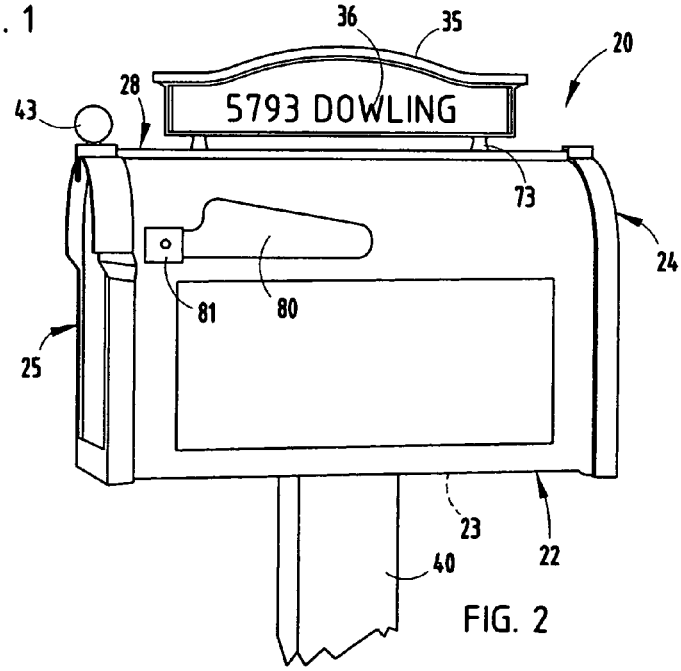
FIG. 2 is a perspective view of the mailbox of FIG. 1, but attached to a top of a post and having topper address signage.
Figure 3:
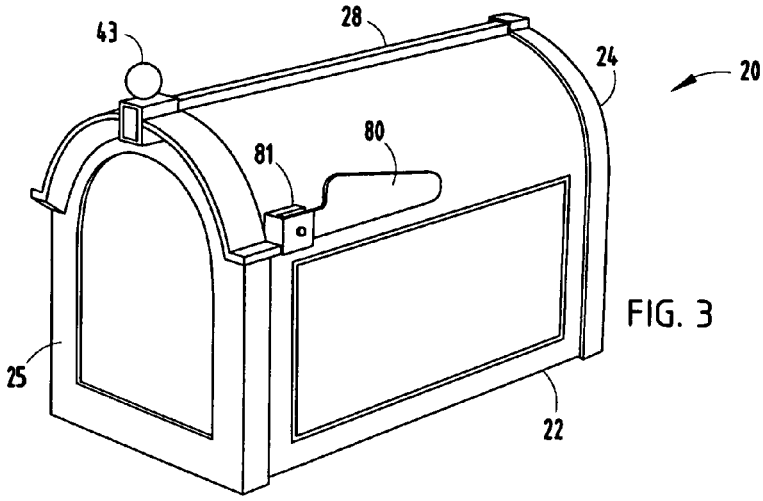
FIG. 3 is a top perspective view of the mailbox of FIG. 1, but without any address signage attached.
Figure 4:
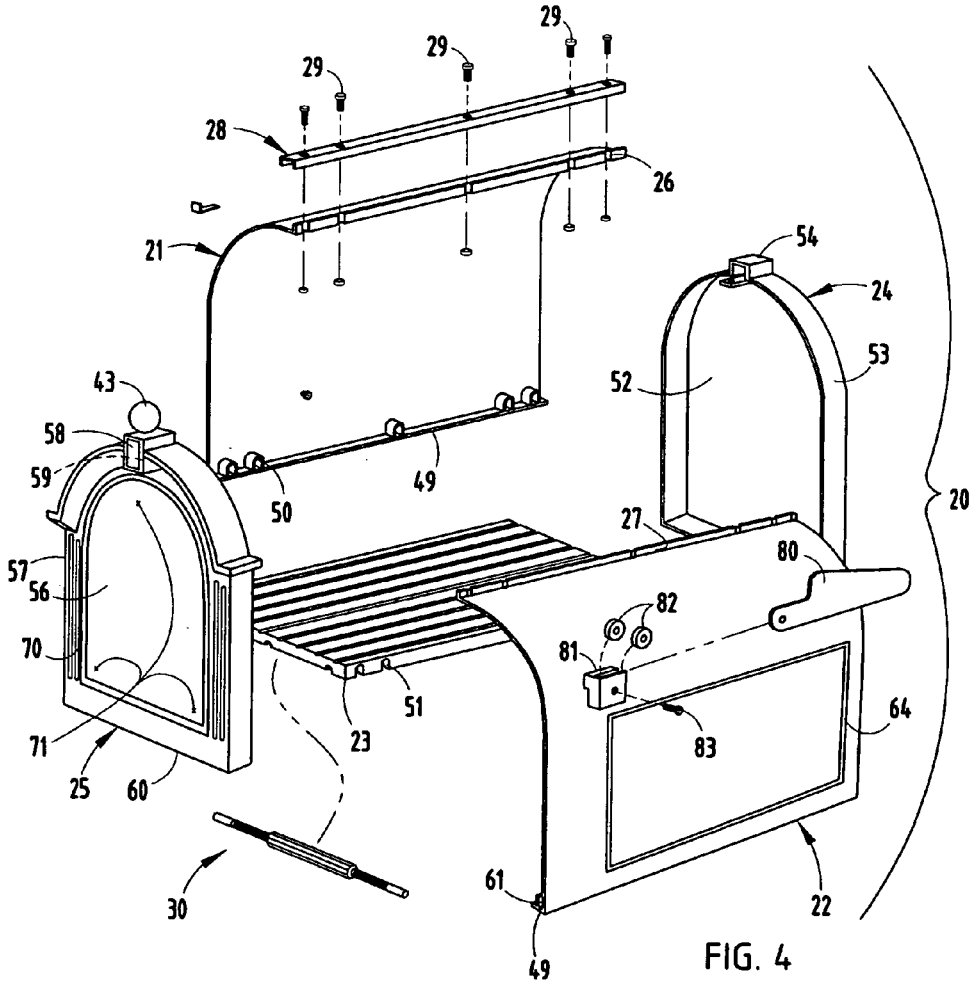
FIGS. 4–6 are exploded perspective views of the mailbox of FIG. 3.
Figure 5:
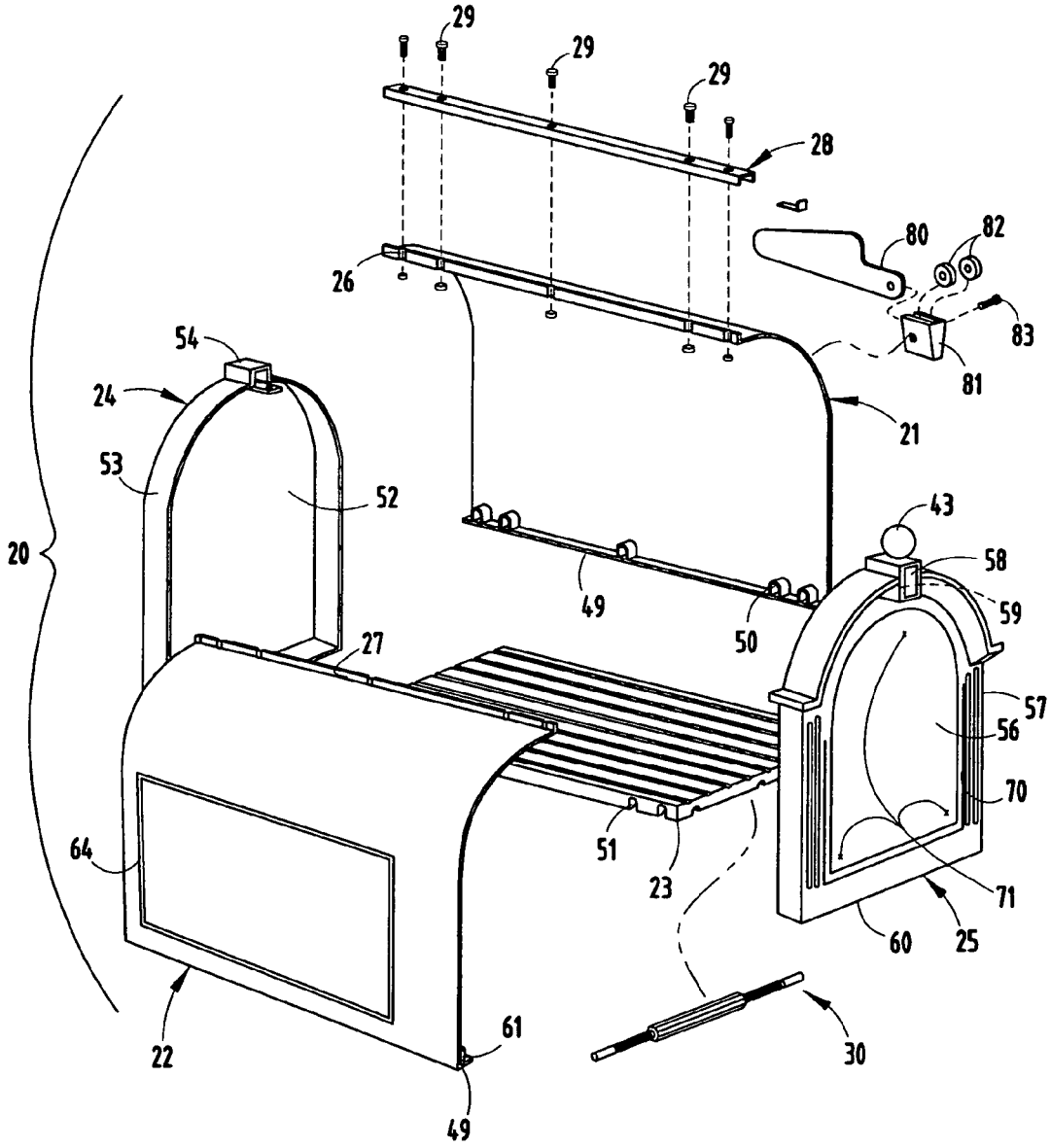

A mailbox 20 (FIG. 1) includes cast aluminum side pieces 21 and 22, a bottom piece 23, a rear piece 24, and a door 25, all die-cast aluminum and surface treated for durability and aesthetics. The side pieces 21, 22 include abutting top flanges 26, 27 (FIG. 4) and an overlapping channel 28 fits over the flanges to hold the flanges 26, 27 together as screws 29 extend downwardly through the channel 28 threadably into engagement between the abutting flanges 26, 27. The side pieces 21, 22, bottom piece 23, and rear piece 24 include features that interfit and that are held together with additional screws threaded into respective apertured bosses in the pieces 21–24, with the heads of the screws engaging an apertured flange to hold the respective parts against the apertured bosses. The door 25 is pivotally secured to the components 21, 22 by a telescopingly expandable hinge pin 30. Flat panel signage 31 and 32 (FIG. 1) with address alpha-numeric information 33 and 34 thereon are configured for attachment to the side pieces 21, 22 and the door 25, respectively. A topper panel signage 35 (FIG. 2) with address alpha-numeric information 36 is configured for attachment above the channel 28. The signage 31–32, and 35 are preferably sand-case aluminum.

The illustrated post 40 (FIG. 1) is a 4×4 stud, and includes a topper piece 41 die-cast with an ornamental ball top 42 which mimics a ball top 43 forming a handle on the door 25. Two brackets 44 include a post-engaging section secured by screws to the post 40, a forwardly-and-upwardly extending ornamental arm 45, and a horizontal section 46 for supporting the mailbox 20. A newspaper holder box 47 (extruded aluminum) is optionally positioned between the arms 45 under the mailbox 20.

The mailbox 20 (FIG. 4) is constructed as follows. The pieces 21–25, 28, and 31–36 are each cast aluminum, and are treated for aesthetics to provide a durable attractive finish. The flanges 26 and 27 of the side pieces 21 and 22 each form half of a hole for receiving the screws 29. When held together by the channel 28, the threads of the screws 29 securely threadably engage the abutting flanges to retain the assembly together at a top of the mailbox 20. The screws 29 have a head that fits into a countersink at a top of the channel 28, so that the screw heads do not extend up above the channel 28. The side pieces 21, 22 each include an inwardly-extending bottom flange 49 on which the bottom piece 23 rests, and further include bosses 50 that fit into mating recesses 51 along the sides of the bottom piece 23. Screws extend through the recesses 51 and threadably into the bosses 50. The rear piece 24 includes a flat panel section 52 and a perimeter flange 53 that extend around at least the sides and top of the side pieces 21, 22. A top of the perimeter flange 53 includes a hollow block section 54 that fits matably around the end of the channel 28.

Figure 6:
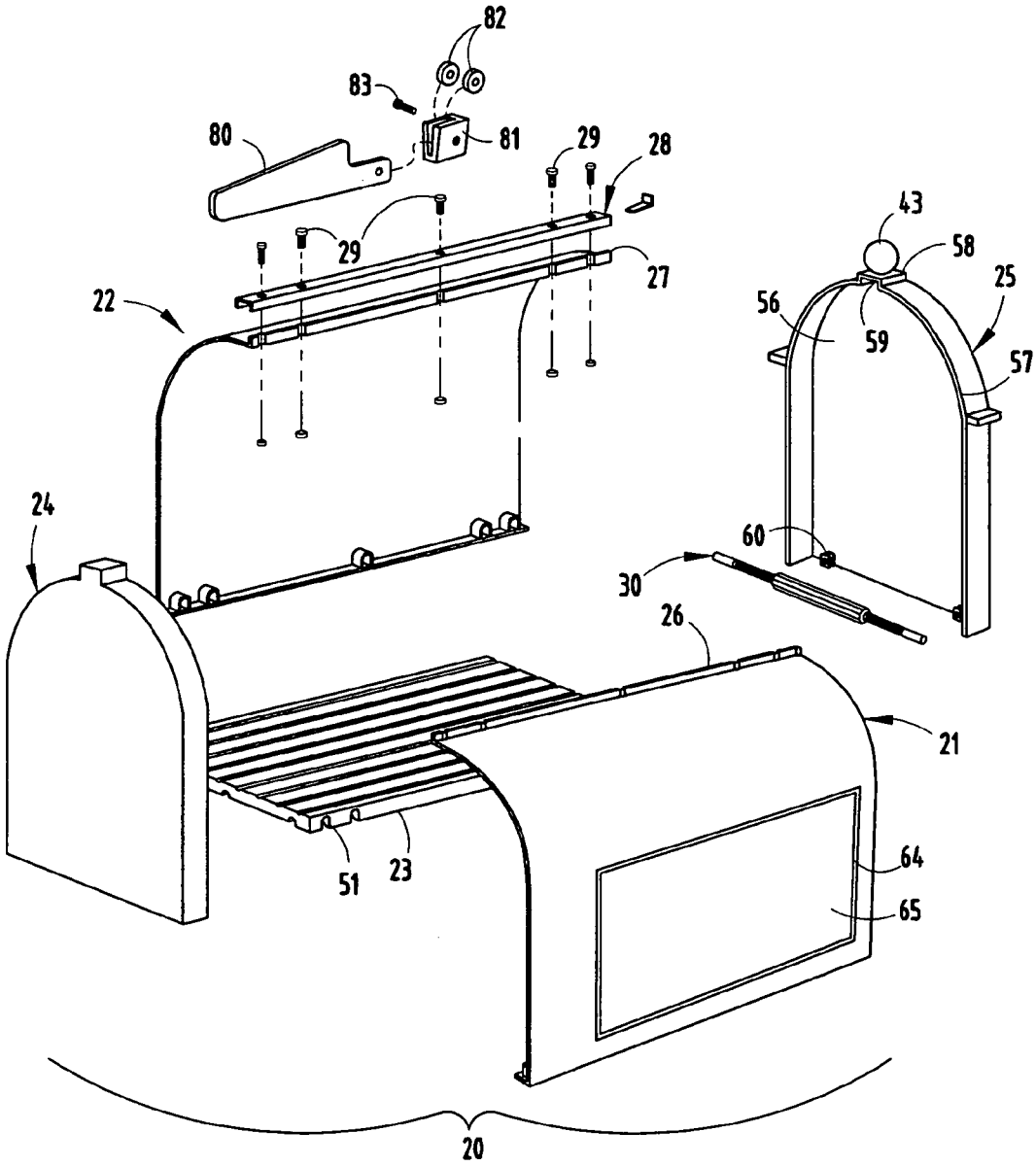

The door 25 (FIG. 6) is shaped similar to the rear piece 24, and includes a flat panel section 56 and a perimeter flange 57 that extends around at least the sides and top of the side pieces 21, 22. A top of the perimeter flange 57 includes a hollow block section 58 that fits matably around the front end of the channel 28. The block section 58 supports the top ball 43 that forms the handle for opening and closing the door 25. A magnet 59 or friction retainer is located within the block section 58 for holding the door 25 in a closed position. The magnet 59 can be adhered in place, or otherwise secured such as by a screw or fastener.

The door 25 (FIG. 6) includes protruding flanges 60 for supporting a center of the telescoping expandable pin 30. The side pieces 21 and 22 include bosses 61 at their bottom corners with inwardly facing apertures for pivotally engaging ends of the pin 30. Reinforcing structure can be attached to a bottom of the door 25, if desired, to reduce a tendency of the door to fall open with significant force from gravity and damage or crack the door-supporting structure. A counterbalance spring and/or frictional material can also be added to the hinge pin to slow the door movement, if desired. Also, a rubber or leaf-spring-like stop can be added to further absorb impact energy and/or distribute stress, if desired.

Figure 7:
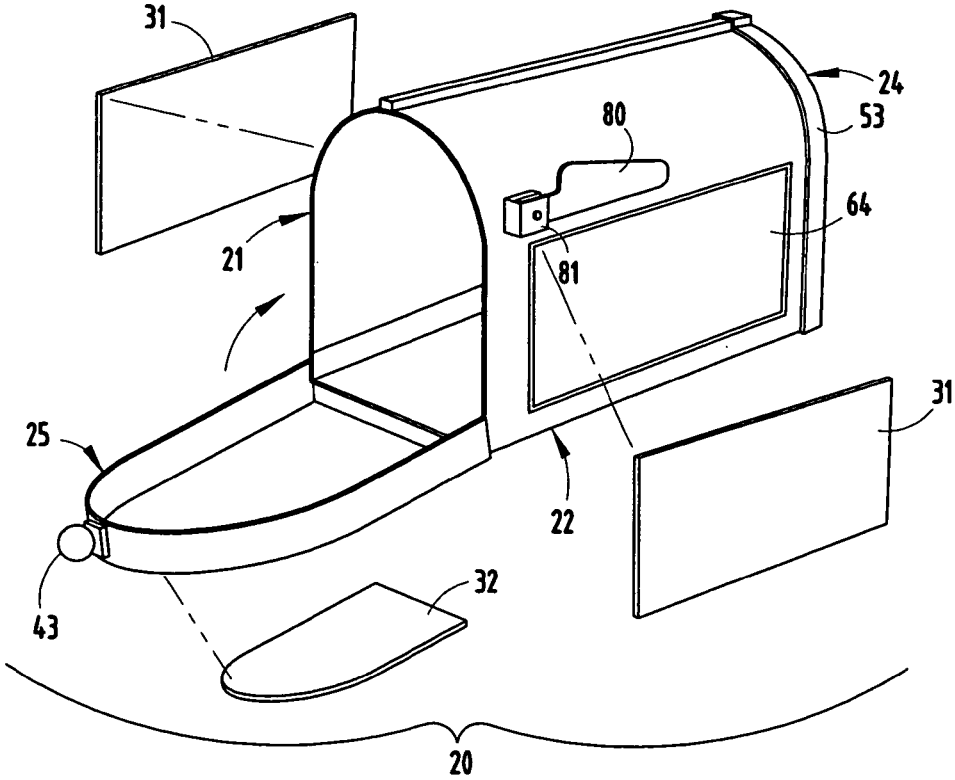
FIG. 7 is an exploded side view of the mailbox with signage plaques shown ready for attachment to the mailbox door and side walls.
Figure 8:
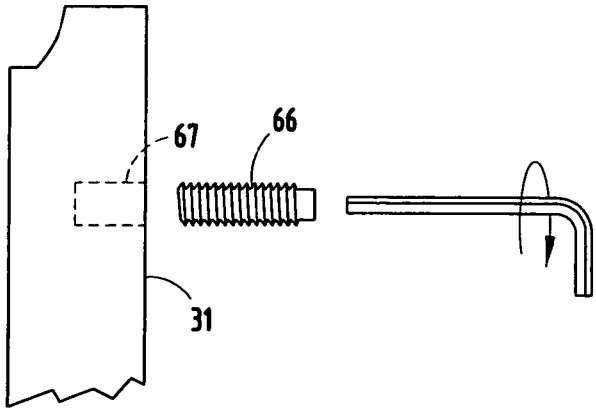
FIGS. 8–9 are side views of assembly schematics, FIG. 8 showing attachment of a threaded stud to the plaques in FIG. 7 and FIG. 9 showing attachment of the plaques to the mailbox with a nut engaging the associated stud.
Figure 9:
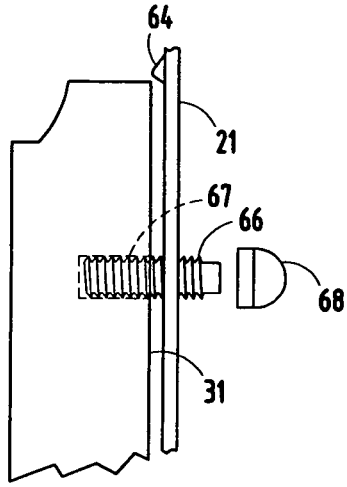

The side pieces 21, 22 (FIG. 6) includes a rectangular flat side panel area, with a rectangular perimeter ridge 64 that breaks up the large flat area when signage is not attached. The outer surface of the mailbox can also be slightly roughened or textured to provide a better looking finish that is less susceptible to scratches and surface damage and blemishes. Two slight depressions 65 (FIG. 6) on the side pieces 21, 22 indicate where holes need to be drilled if someone wants to attach the side panel signage 31. A threaded shaft 66 (FIG. 8) is installed into a hole 67 in a back of the signage 31 using an Allen wrench. The signage 31 is then manipulated to extend the threaded shafts 66 through the drilled holes (FIGS. 7–8). The signage 31 has a shape that fits matably into the area defined by the ridge 64, so that the assembly provides a tight aesthetic appearance. Nuts 68 are threaded onto the inner ends of the threaded shafts 66, from an inside of the mailbox 20. The alpha-numeric information 33 is pre-attached to the signage 31, such as by factory installation or by attachment by the consumer. The information 33 can be attached by various ways known in the art, including adhesive, double-sided tape, screws, and other ways known in the art. Templates can be provided for optimally locating the information 33.

The door 25 (FIG. 4) includes a flat area with a perimeter ridge 70 similar to the perimeter ridge 64 on the side pieces 21, 22. The signage 32 is shaped to fit within the ridge 70. Depressions 71 are formed on the door to assist in the drilling holes. The method of attachment of the signage 32 to the door 25 is similar to attachment of the signage 31 to the side pieces 21, 22.

Figure 10:
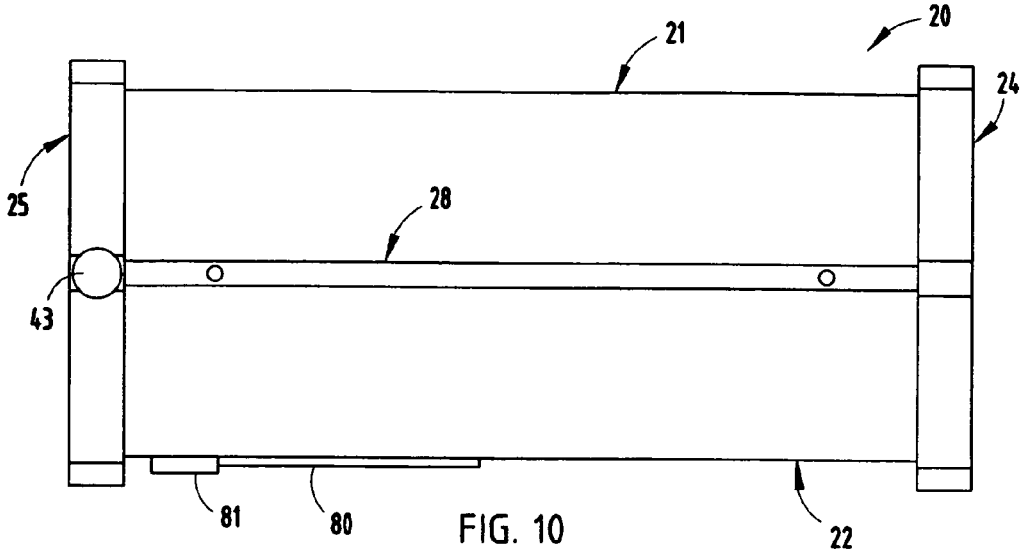
FIG. 10 is a top view of the mailbox shown in FIG. 3.
Figure 11:
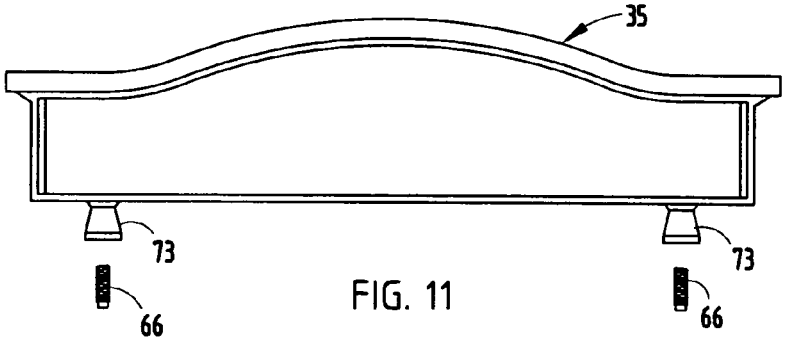
FIG. 11 is a side view of a topper address plaque, including threaded studs.
Figure 12:
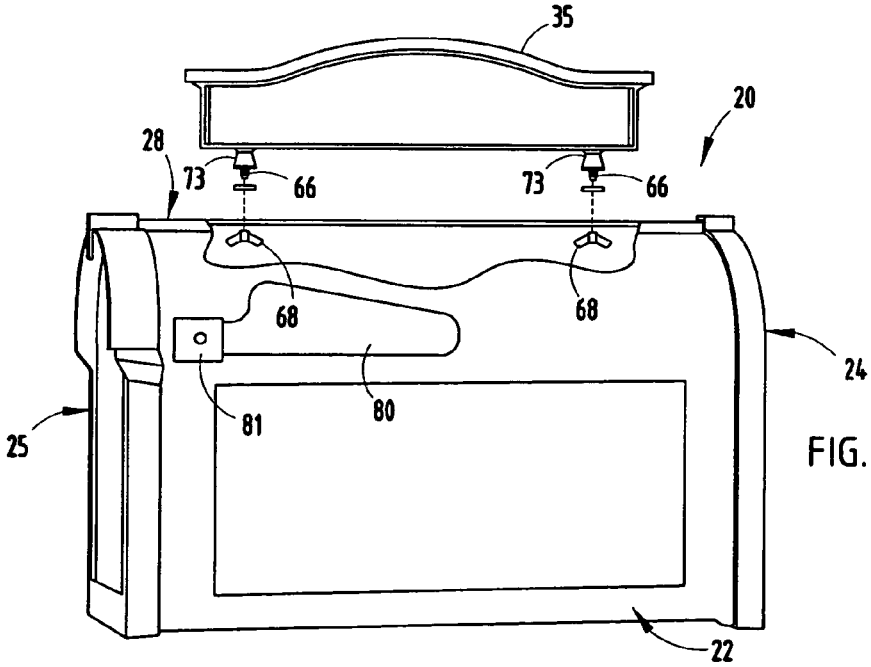
FIG. 12 is a fragmentary side view of the mailbox, including nuts engaging the threaded studs of the topper address plaque.

The topper panel signage 35 (FIGS. 10–12) is attached by removing two of the screws 29 that secure the channel 28 in place. Threaded shafts 66 are extended into the bosses 73 that extend downwardly from a bottom of the topper panel signage 35. The topper panel signage 35 is then manipulated to position the shafts 66 into the holes (where the screws 29 were removed), and nuts 68 are threaded onto the threaded shafts 66 from inside the mailbox 20 to hold the topper panel signage 35 in place.

The flag 80 (FIG. 4) is pivotally mounted to a side of the right side piece 21 by a mount 81 and washer 82. A screw 83 extends through the mount 81, two washers 82, and flag 80 threadably into the side piece 21. The washers 82 are positioned on opposite sides of the flag and take up stress so that the flag 80 is not bound up by over-torqueing the screw 83. Two adjacent sides of the mount 81 are open, so that the flag 80 can be pivoted between a raised "flagging" position and a lowered storage position.

MODIFICATION

Figure 13:
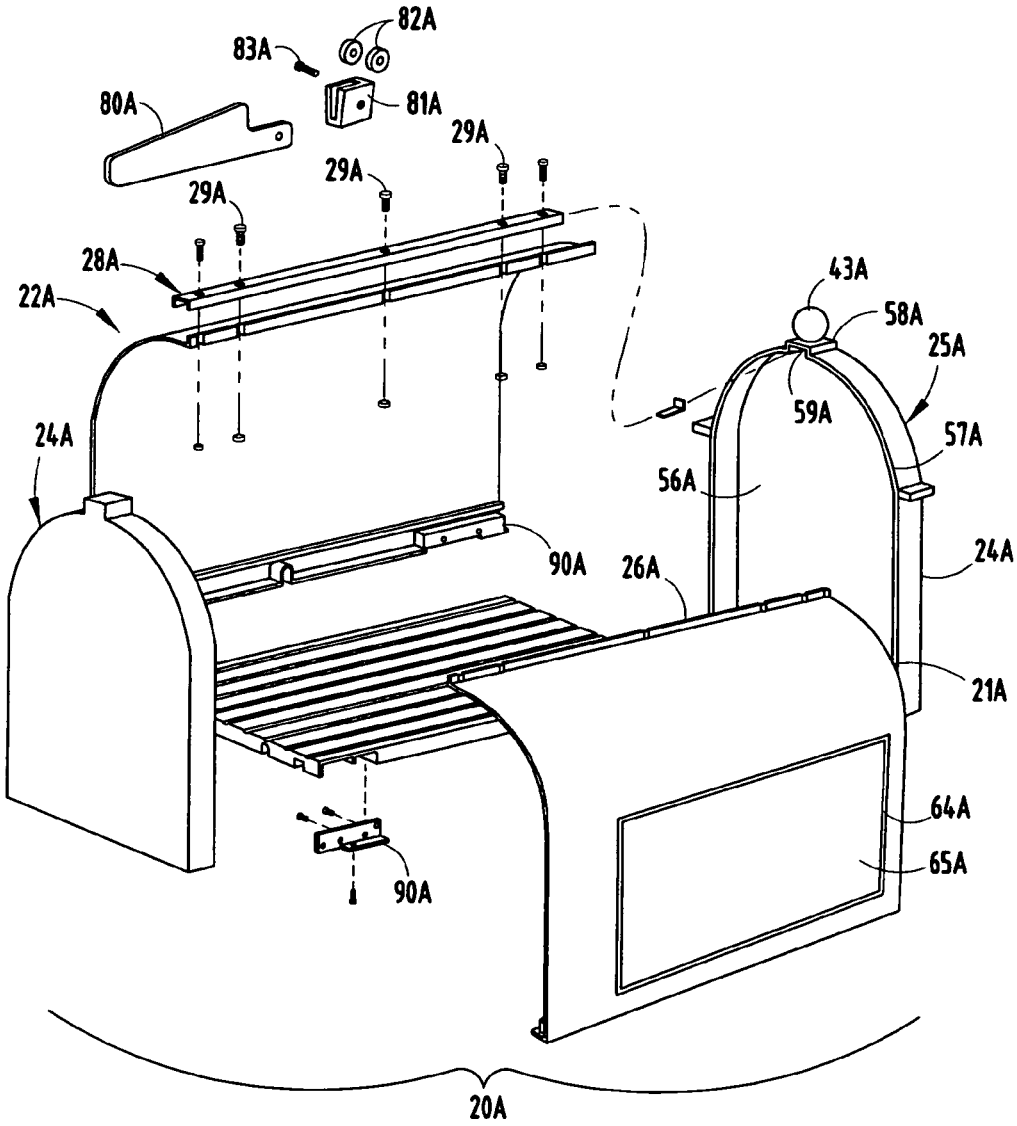
FIGS. 13–15 are exploded rear, front, and bottom perspective views of a modified mailbox according to the present invention.
Figure 14:
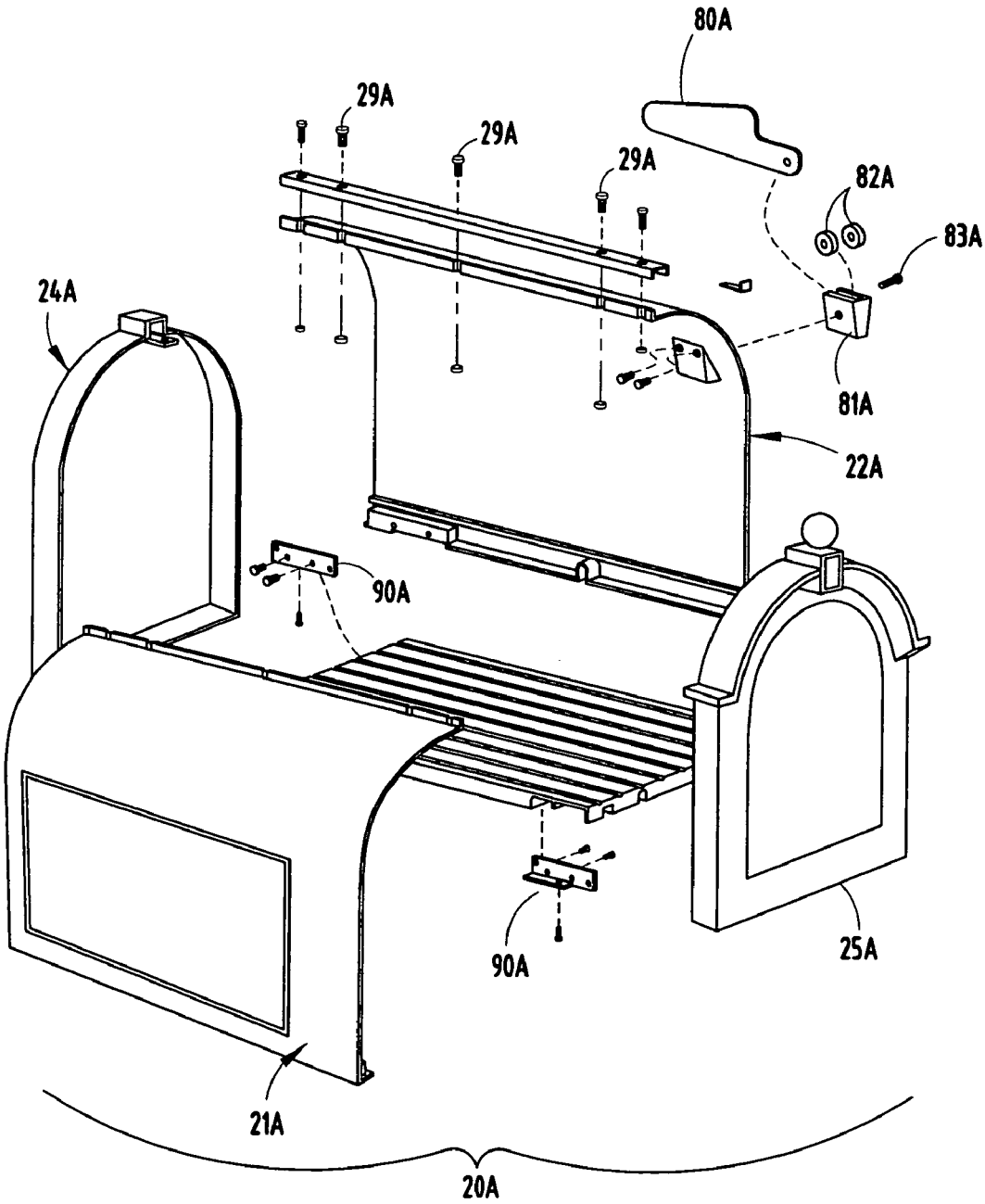
Figure 15:
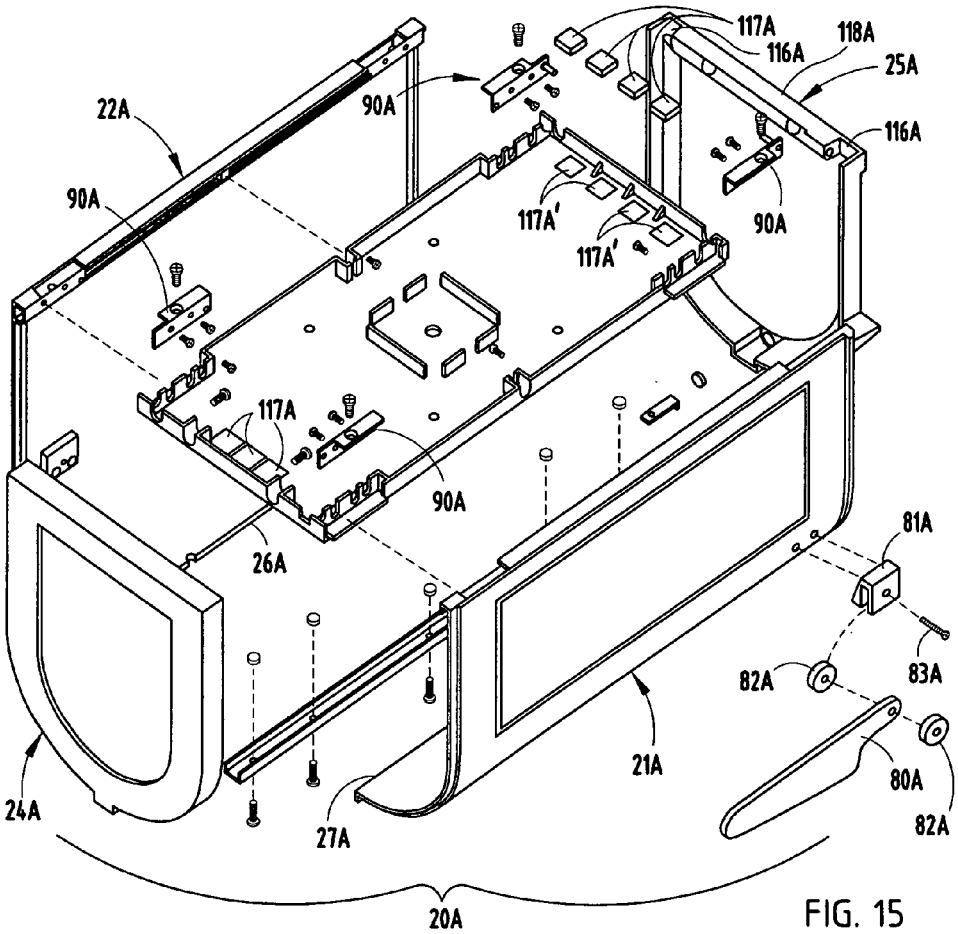

A modified mailbox 20A (FIGS. 13–15) includes similar and identical components to mailbox 20. The same identification numbers are used in mailbox 20A to identify similar and identical components, features, and characteristics as were used for mailbox 20, but with the addition of the letter "A". This is done to reduce redundant discussion, and not for another purpose.

Mailbox 20A (FIG. 13) includes cast aluminum side pieces 21A, 22A, a bottom piece 23A, a rear piece 24A, and a door 25A, all hand-cast and surface treated for durability and aesthetics. Like mailbox 20, the side pieces 21A, 22A include abutting top flanges 26A, 27A and an overlapping channel 28A fits over the flanges and combines with screws 29A extended through the channel and into the flanges 26A, 27A to hold the side pieces 21A and 22A together. The side pieces 21A, 22A, bottom piece 23A, and rear piece 24A include features that interfit and that are held together with additional screws threaded into respective apertured bosses in the pieces 21A–24A, with the heads of the screws engaging an apertured or notched flange to hold the respective parts against the apertured bosses. The side pieces 21A, 22A and the door 25A are configured to receive flat panel signage (see FIG. 1) and/or topper panel signage (see FIG. 2).

The mailbox 20A (FIG. 15) includes four corner stiffeners 90A, one being attached at each bottom corner of the mailbox 20A for improving an overall durability of the mailbox, and further includes a modified hinge arrangement that combines with the corner stiffeners 90A for improving a durability of the door mounting.

Figure 16:
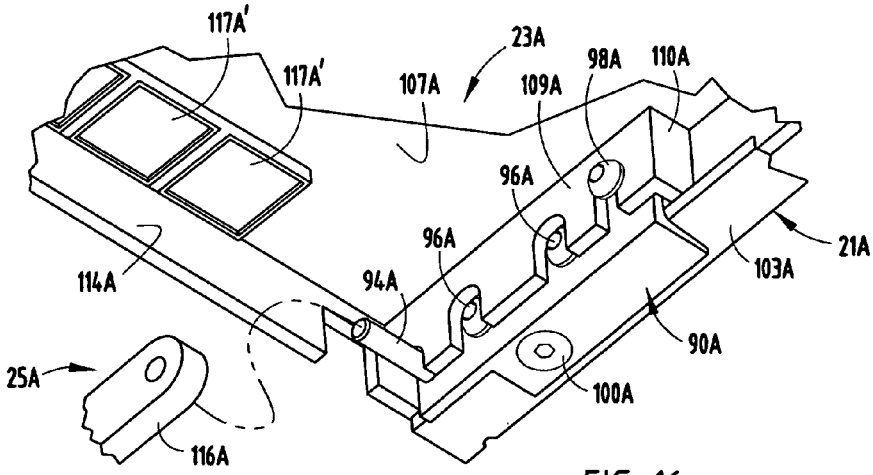
FIG. 16 is an enlarged, bottom view of a front corner of the mailbox.
Figure 16A:
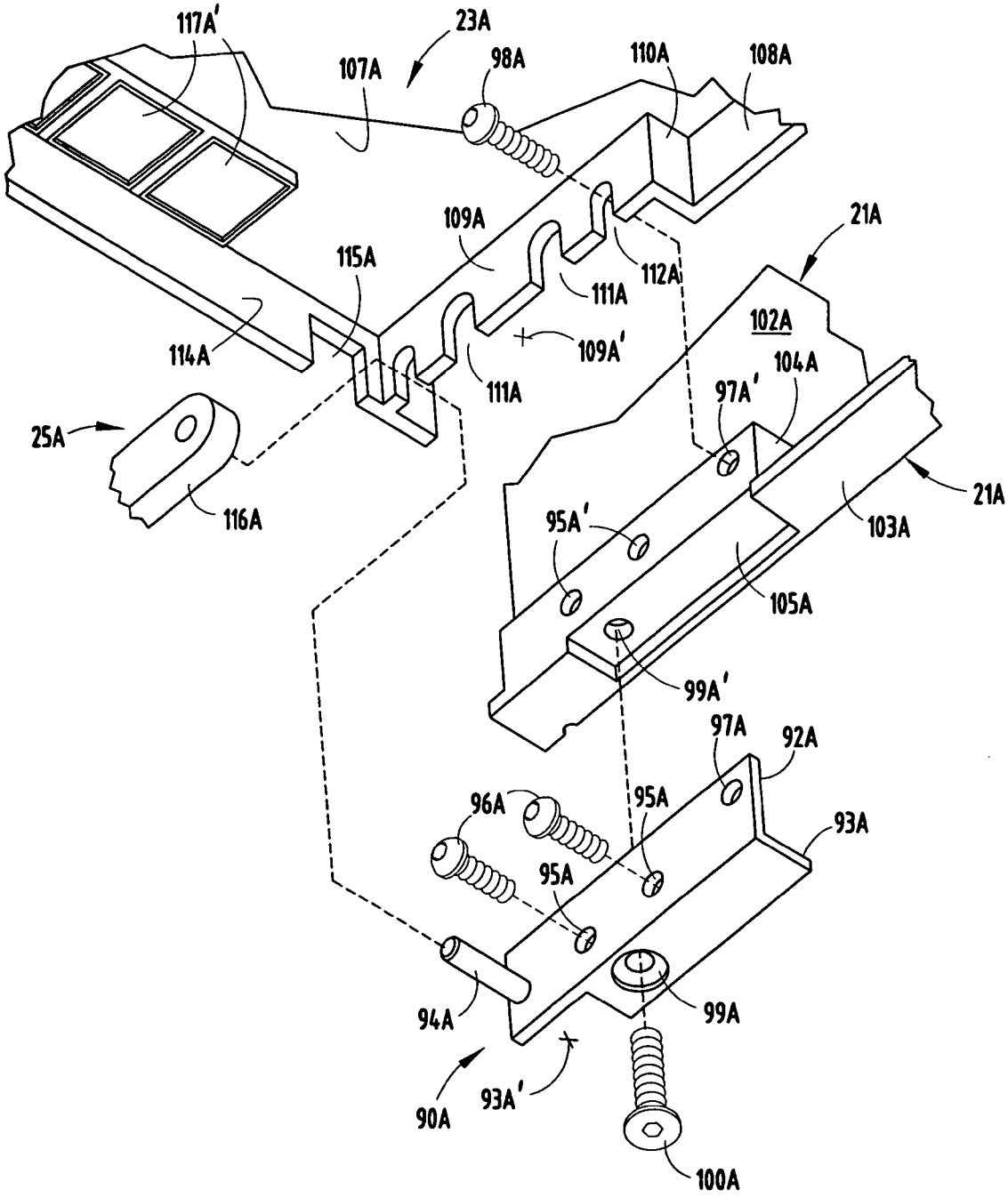
FIG. 16A is an exploded view of FIG. 16.
Figure 17:
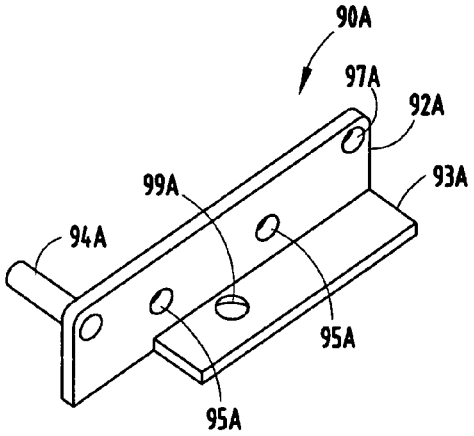
FIGS. 17–18 are front and rear perspective views of the corner reinforcer shown in FIG. 16.
Figure 18:
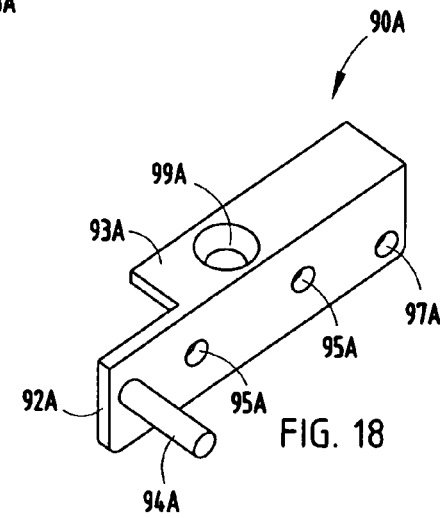
Figure 19:
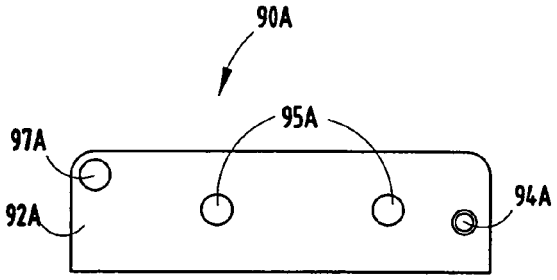
FIGS. 19–21 are orthogonal views of the FIG. 17.
Figure 20:
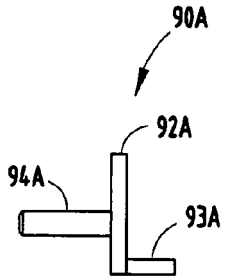
Figure 21:
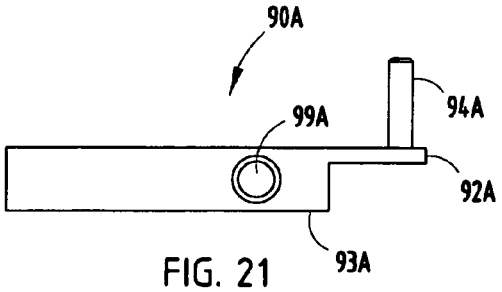

Specifically, the front two corner stiffeners 90A (FIG. 16A) are made from stainless steel or other durable material treated for outdoor use. The front two corner stiffeners 90A each include an elongated L-shaped plate having a first flange 92A oriented vertically, and a second flange 93A oriented horizontally in a direction generally parallel the bottom piece 23A. The first flange 92A supports a laterally-extending pivot pin 94A at one end. Two holes 95A are formed along first flange 92A for receiving attachment screws 96A for attaching the stiffener 90A to the side piece 21A (or 22A). Another hole 97A is formed in first flange 92A at the other end of the stiffener 90A (i.e. opposite from the end with the pin 94A) for receiving an attachment screw 98A for attaching the bottom piece 23A to the side piece 21A (or 22A). The second flange 93A includes another hole 99A for receiving a screw 100A for securing the corner stiffener 90A to the side piece 21A (or 22A). Notably, the second flange 93A is shorter than first flange 92A, and in particular second flange 93A terminates short of the area of pivot pin 94A to create a notch 93A' so that it does not interfere with movement of the door 25A, as discussed below. Notably, the front two corner stiffeners 90A include right and left versions which are mirror images of each other. (Compare the corner stiffeners 90A in FIGS. 16A and 118.) The illustrated front two corner stiffeners 90A include a pivot pin 94A. However, the pin 94A in the rear two corner stiffeners 90A is eliminated. In fact, the rear two corner stiffeners 90A are aluminum stampings used more for filling the associated space in the bottom piece 23A than for stiffening. By this design of the bottom piece 23A, the bottom piece 23A is symmetrical and potentially can be reversed end-to-end without causing an assembly problem. Alternatively, it is conceived that a corner reinforcing piece could be used, if desired.

The lower edge of the side pieces 21A and 22A are modified at their front and rear corners to receive and support the corner stiffeners 90A. The attachment of the side pieces 21A and 22A to the bottom piece 23A and to the corner stiffeners 90A are similar, such that only the side pieces 21A is described hereafter. Specifically, the side piece 21A (FIG. 16A) includes a side panel 102A and a lower flange 103A. An enlarged boss 104A is formed at the corner at a height of the lower flange 103A, and a recess 105A is cut away from the lower flange 103A along a portion of the enlarged boss 104A. The enlarged boss 104A includes holes 95A', 97A' and 99A' that align with the holes 95A, 97A, and 99A. The holes 95A', 97A', and 99A' are sized so that the screws 96A, 98A, and 100A threadably engage the holes to retain the assembly of the side piece 21A and bottom piece 23A together. (Alternatively, self-tapping screws can be used.) The cut-away recess 105A is sized to matably receive the second flange 93A, with the first flange 92A lying flat against an inboard surface 106A of the boss 104A in a laminar arrangement.

The bottom piece 23A (FIG. 16A) includes a bottom panel 107A and a downwardly-extending perimeter flange 108A. At the corner, the perimeter flange 108A includes an outwardly facing recess 109A' bounded by an inwardly-offset long section 109A and a perpendicular short section 10A that connects the long section 109A to the perimeter flange 108A. The recess 109A' fits around the enlarged boss 104A with the corner stiffener 90A attached to the boss 104A. The long section 109A includes notches 111A that are large enough to avoid interference with the head of the screws 97A, thus allowing the corner stiffener 90A to be attached to the enlarged boss 104A prior to assembly of the bottom piece 23A to the side piece 21A. The long section 109A also includes a narrower notch 112A that is small enough so that the head of the screw 98A engages the long section 109A, thus helping to secure the bottom piece 23A to the side piece 21A.

Figure 22:
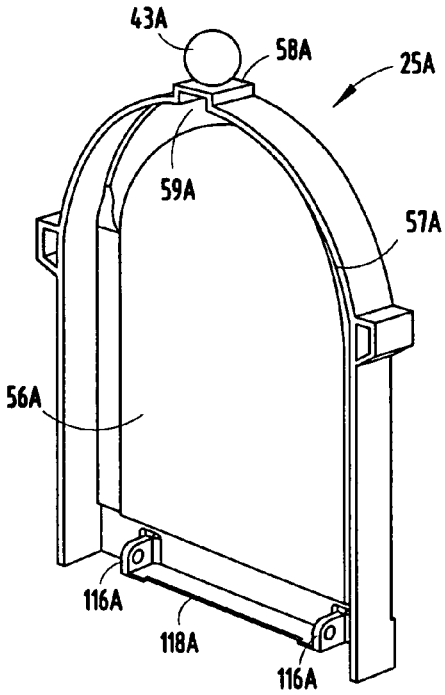
FIGS. 22–25 are perspective, rear, side, and front views of FIG. 19.
Figure 23:
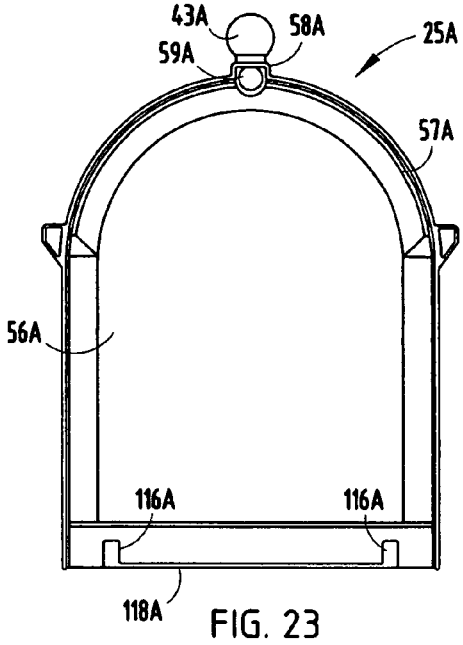
Figure 24:
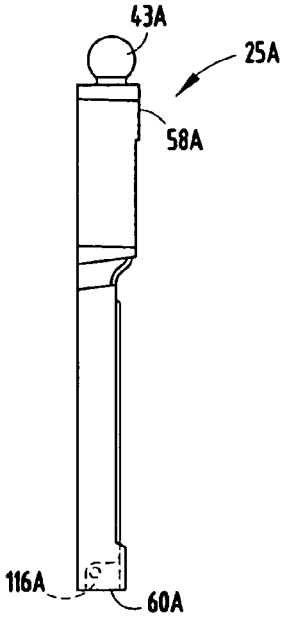
Figure 25:
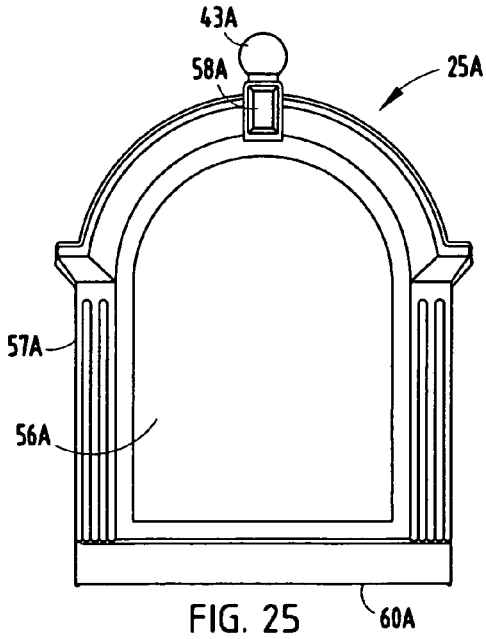

The perimeter flange 108A of the bottom piece 23A (FIG. 16A) includes a front perimeter flange 114A that continues from the front end of long section 109A across a front of the bottom piece 23A. A notch 115A is formed near the corner of the bottom piece 23A for receiving a mounting pivot boss 116A on the door 25A. This allows the apertured mounting pivot boss 116A to fit through the notch 115A into rotating engagement with the pivot pin 94A. A series of square (or rectangular or other shaped) pockets 117A' are formed along and inboard of the front perimeter flange 114A. These pockets 117A' receive a series of rubber pads 117A (FIG. 15) adapted to engage a flange 118A on the door 25A that extends between the mounting pivot bosses 116A (FIG. 22) as the door 25A is opened. Thus, the pads 117A dampen the opening movement of the door 25A as it approaches its extreme opened position. This may be important for long term durability where the door 25A is allowed to fall open (or "thrown" open) during an abuse condition. Also, where heavy cast signage (such as signage 32, FIG. 1) is attached to the door 25A, and where the hinge arrangement is loose and not slowed by friction of the hinge pin, the door 25A may swing open by gravity with surprising force.

In additional to the functional aspects, the present appearance and design are believed to be novel, ornamental, non-obvious, and hence patentable.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. A mailbox comprising:

opposing side pieces, a bottom piece, and a rear piece secured together, and a door operably attached for closing a front opening therein; the side pieces including abutting top flanges and including a channel engaging the top flanges to hold the top flanges together; and fasteners securing the channel in engagement with the top flanges.

2. The mailbox defined in claim 1, wherein the opposing side pieces, the bottom piece, and the rear piece are made from cast material.

3. The mailbox defined in claim 2, wherein at least the cast material is aluminum.

4. The mailbox defined in claim 3, wherein the fasteners include screws threadably engaging at least one of the channel and the flanges.

5. A kit comprising:

a mailbox having a box portion and a door;

a plurality of address panel signage, including a first signage shaped to fit against a side of the box portion, a second signage shaped to fit against the door, and a third signage shaped with down bosses for attachment to a top of the box portion;

threaded studs having a first portion adapted to threadably engage a selected one of the panel signage and having a second portion extending therefrom in a pattern; and nuts shaped to engage the second portion of the threaded studs to secure the selected one of the panel signage to the box portion or the door.

6. A mailbox comprising:

a mailbox portion having an open end;

a door shaped to close the open end; and a hinge with pivot pin, the pin having a center engaging the door and having ends engaging pockets in sides of the mailbox portion near the open end, the pin being telescopingly extendable to facilitate assembly.

7. A mailbox comprising:

a mailbox having an open end and including at least one cast component;

a door shaped to close the open end; and corner stiffeners attached to lower front corners of the mailbox, the corner stiffeners being attached to the cast component, the corner stiffeners pivotally engaging the door and supporting the door for opening and closing movement.

8. The mailbox defined in claim 7, wherein one of the door and the corner stiffeners include at least one pivot pin and the other includes at least one mating aperture operably receiving the pivot pin for supporting the door for opening and closing movement.

9. The mailbox defined in claim 7, wherein the mailbox includes opposing side pieces and a bottom piece, each being made of cast material, the corner stiffeners including right and left stiffeners that engage and are mechanically attached to the front corners.

10. The mailbox defined in claim 9, wherein the right and left stiffeners each include a first hole opening toward an associated one of the side pieces and a second hole opening toward the bottom piece, and including a first screw engaging the first hole and securing the respective corner stiffener to the associated side piece, and a second screw engaging the second hole and securing the bottom piece to the corner stiffener.

11. The mailbox defined in claim 7, wherein the stiffener has an L-shaped cross section.

12. The mailbox defined in claim 7, wherein the stiffener incorporates a hinge pin for pivotally supporting the door.

* * * * *